US010527049B2

(12) United States Patent
Zhu et al.

(10) Patent No.: US 10,527,049 B2
(45) Date of Patent: Jan. 7, 2020

(54) SYSTEM AND METHOD FOR MEASURING BENDING MODE FREQUENCIES

(71) Applicant: SOLAR TURBINES INCORPORATED, San Diego, CA (US)

(72) Inventors: Lei Zhu, San Diego, CA (US); Jason Wing-bin Fong, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 555 days.

(21) Appl. No.: 15/266,682

(22) Filed: Sep. 15, 2016

(65) Prior Publication Data

US 2018/0073516 A1 Mar. 15, 2018

(51) Int. Cl.

| | |
|---|---|
| ***H01L 41/18*** | (2006.01) |
| ***G05B 15/02*** | (2006.01) |
| ***H02K 7/09*** | (2006.01) |
| ***F04D 29/058*** | (2006.01) |
| ***F04D 17/10*** | (2006.01) |
| ***F04D 29/58*** | (2006.01) |
| ***F04D 27/00*** | (2006.01) |
| ***F04D 29/053*** | (2006.01) |
| ***F04D 29/66*** | (2006.01) |

(52) U.S. Cl.

CPC ..... *F04D 29/058* (2013.01); *F04D 17/10* (2013.01); *F04D 27/001* (2013.01); *F04D 29/053* (2013.01); *F04D 29/584* (2013.01); *F04D 29/668* (2013.01)

(58) Field of Classification Search

CPC ..... H02K 7/09; H02K 15/02; H02K 1/28

See application file for complete search history.

(56) References Cited

U.S. PATENT DOCUMENTS 5,998,899 A * 12/1999 Rosen ..... F16C 32/0446 310/112

2013/0257223 A1* 10/2013 Kataoka ..... H02N 2/142 310/317

2016/0139083 A1* 5/2016 Castane Selga .... F16C 32/0444 73/579

* cited by examiner

*Primary Examiner* — Kawing Chan

*Assistant Examiner* — Charles S Laughlin

(74) *Attorney, Agent, or Firm* — Procopio, Cory, Hargreaves & Savitch LLP

(57) ABSTRACT

A system and method for controlling bending modes of a rotor assembly is disclosed. The rotor assembly can be supported by one or more bearings in an integrated machine. The method can include accelerating the rotor assembly to a first rotational speed via a first torsional force applied to the drive shaft and then removing the first torsional force. The method can also include obtaining first measurements of the rotational speed and frequency of one or more bending modes of the rotor assembly during a first rotary machine coast down period from the first rotational speed. The process can be repeated to determine a relationship between rotational speed, bending mode frequency, and gain. The one or more bearings can then be controlled based on the measurements and the relationship. The system can have one or more processors or controllers to implement the method.

13 Claims, 5 Drawing Sheets

SYSTEM AND METHOD FOR MEASURING BENDING MODE FREQUENCIES

TECHNICAL FIELD

The present disclosure generally pertains to rotary machines and more particularly to measuring bending mode frequencies within an integrated motor driven gas compressor.

BACKGROUND

Electric motors convert electrical energy to mechanical energy to drive rotary machines, such as centrifugal gas compressors. The electric motor and the rotary machine can be assembled into a single housing. This integrated system, or integrated machine, may be more compact than a separate electric motor and rotary machine system. The rotating parts of any rotary machine have resonance frequencies, where such rotating parts, for example, a drive shaft, can physically bend. The bending shape of such a rotating part at such a resonance frequency is referred to herein as a mode. If left uncontrolled, modes can present a destructive force to both the electric motor and the rotary machine.

The present disclosure is directed toward overcoming one or more problems discovered by the inventors or that is known in the art.

SUMMARY

An aspect of the disclosure provides a method for controlling bending modes of a rotor assembly supported by one or more bearings in an integrated machine. The integrated machine can have a rotary machine operably coupled to a motor via a drive shaft and controlled by a control system. The method can include accelerating the rotary machine to a first rotational speed via a first torsional force applied to the drive shaft by the motor. The method can also include removing the first torsional force. The method can also include obtaining first measurements of the rotational speed and frequency of one or more bending modes of the rotor assembly during a first coast down period from the first rotational speed. The method can also include accelerating the rotary machine to a second rotational speed different from the first rotational speed via a second torsional force applied to the drive shaft by the motor. The method can also include removing the second torsional force. The method can also include obtaining second measurements of the rotational speed and the frequency of the one or more bending modes of the rotor assembly during a second coast down period from the second rotational speed. The method can also include controlling the one or more bearings based on the first measurements and the second measurements.

Another aspect of the disclosure provides a device for controlling one or more magnetic bearings of an integrated machine. The device can include rotary machine. The device can also include a motor. The device can also include a drive shaft coupling the rotary machine to the motor to define a rotor assembly supported by one or more magnetic bearings. The device can also include a control system coupled to the motor and the one or more magnetic bearings. The control system can accelerate the rotary machine to a first rotational speed via a first torsional force applied to the draft shaft by the motor. The control system can also remove the first torsional force. The control system can also obtain first measurements of the rotational speed and frequency of one or more bending modes of the rotor assembly during a first coast down period from the first rotational speed. The control system can also accelerate the rotary machine to a second rotational speed different from the first rotational speed via a second torsional force applied to the drive shaft by the motor. The control system can also remove the second torsional force. The control system can also obtain second measurements of the rotational speed and the frequency of the one or more bending modes of the rotor assembly during a second coast down period from the second rotational speed. The control system can also control the one or more bearings based on the first measurements and the second measurements.

Another aspect of the disclosure provides an apparatus for controlling bending modes of a rotor assembly supported by one or more bearings. The apparatus can have means for accelerating the rotor assembly to a first rotational speed via a first torsional force applied to the rotor assembly;

means for removing the first torsional force. The apparatus can have means for obtaining first measurements of the rotational speed and frequency of one or more bending modes of the rotor assembly during a first coast down period from the first rotational speed. The apparatus can have means for accelerating the rotor assembly to a second rotational speed different from the first rotational speed via a second torsional force applied to the rotor assembly. The apparatus can have means for removing the second torsional force. The apparatus can have means for obtaining second measurements of the rotational speed and the frequency of the one or more bending modes of the rotor assembly during a second coast down period from the second rotational speed. The apparatus can have means for controlling the one or more bearings based on the first measurements and the second measurements.

Other features and advantages will be apparent to one of ordinary skill with a review of the following detailed description.

DETAILED DESCRIPTION

The systems and methods disclosed herein include an integrated machine including an electric motor and a rotary machine within a common housing. In embodiments, the electric motor and its components are located within a housing. The electric motor can drive the rotary machine over a range of rotational speeds. As the rotor within the rotary machine rotates, various modes are presented at different frequencies based on the rpm or rotational speed of the drive shaft. Modes are reflected in physical deflection of the rotor assembly, based on the natural or resonant frequency of the rotor assembly as it spins. If left uncontrolled, the deflection of the rotor assembly can damage bearings and other components of the system.

Figure 1:
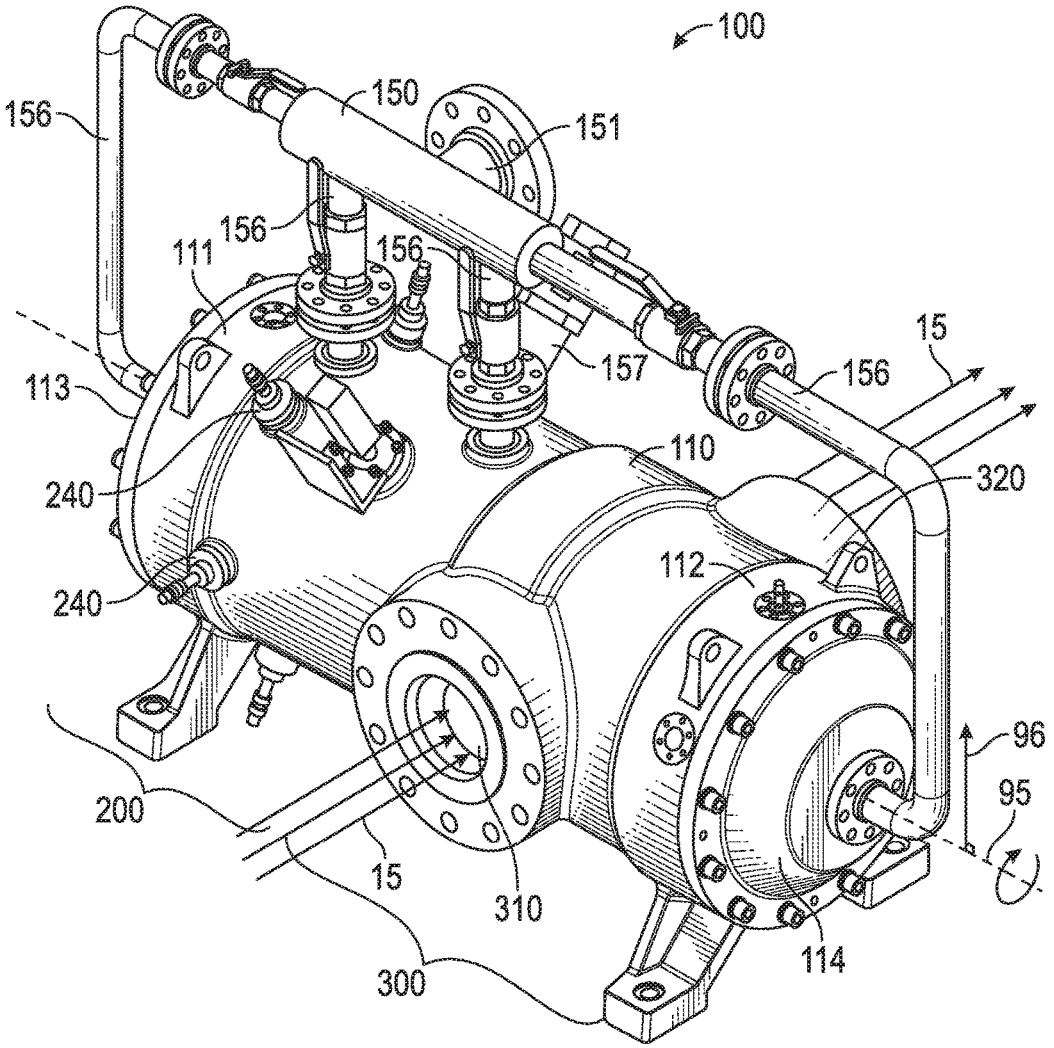
FIG. 1 is a perspective view of an exemplary gas compressor integrated machine.

FIG. 1 is a perspective view of an exemplary integrated machine 100. In the example depicted, the integrated machine 100 is a gas compressor. Some of the surfaces may have been left out or exaggerated (here and in other figures) for clarity and ease of explanation. Also, the disclosure may reference a forward and an aft direction. Generally, all references to "forward" and "aft" are associated with a flow direction of a gas within the integrated machine 100. In the embodiment illustrated, the first end 111 is the forward end and the second end 112 is the aft end.

Figure 2:
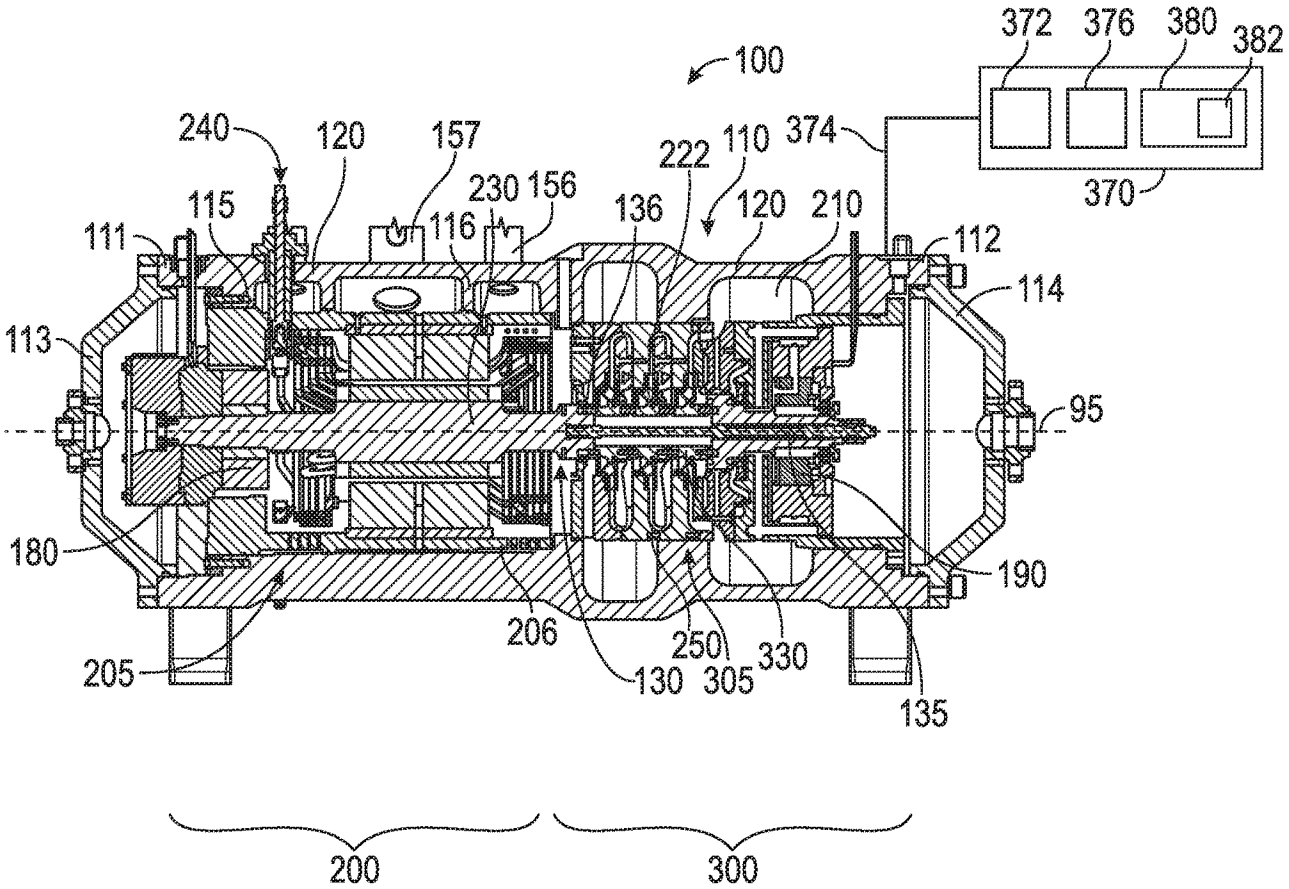
FIG. 2 is a cross-sectional view of the integrated machine of FIG. 1.

In addition, the disclosure may generally reference a center axis 95 of rotation of the rotary machine, which may be generally defined by the longitudinal axis of a rotor assembly 130 (shown in FIG. 2) of the integrated machine. The center axis 95 may be common to or shared with various other concentric components of the integrated machine 100, such as housing 110 and a motor or motor assembly 205 (FIG. 2). All references to radial, axial, and circumferential directions and measures refer to center axis 95, unless specified otherwise, and terms such as "inner" and "outer" generally indicate a lesser or greater radial distance, respectively, from the center axis 95. A radial 96 may be in any direction perpendicular and radiating outward from center axis 95.

The integrated machine 100 includes a housing 110, a motor section 200, and a rotary machine section 300. The housing 110 can include an outer shell 120 (FIG. 2) with a first end 111 and a second end 112. In the embodiment illustrated, the motor section 200 is adjacent the first end 111 and the rotary machine section 300 is adjacent the second end 112. The motor section 200 includes one or more power connectors 240 extending through the housing 110 to supply power to the motor assembly 205. The rotary machine section 300 includes a rotary machine 305 (FIG. 2). In the embodiment illustrated, the rotary machine 305 is a centrifugal gas compressor. The rotary machine section 300 can have a suction port 310 adjacent the motor section 200 and a discharge port 320 adjacent the second end 112, aft of the suction port 310. In other embodiments, the flow may be in the opposite direction with the suction port 310 being adjacent the second end 112 and the discharge port 320 being adjacent the motor section 200. The integrated machine 100 can also have a first end cap 113 connected to the first end 111 of the housing 110 and a second end cap 114 connected to the second end 112 of the housing 110.

The integrated machine 100 can include coolant supply lines 150 for supplying a coolant, such as air to the integrated machine 100. The coolant supply lines 150 can have a supply connection 151 operable to connect to a coolant supply. In the embodiment shown, coolant inlet lines 156 connect to each end cap of the integrated machine 100 and two coolant inlet lines 156 connect to the housing 110 at the motor section 200. In the embodiment illustrated, a coolant outlet line 157 also connects to the housing 110 at the motor section 200. The coolant supply lines 150 may include various flanges, fittings, and valves for connecting to the coolant supply and for controlling the flow of the coolant.

FIG. 2 is a cross-sectional view of the integrated machine 100 of FIG. 1. The rotor assembly 130 may include a drive shaft 230 (located within the motor section 200) joined to a machine rotor 330 (located within the rotary machine section 300). In the embodiment illustrated, drive shaft 230 and machine rotor 330 can be joined by a tierod 135 and may not need a coupling. Drive shaft 230 and machine rotor 330 may also be joined by one or more fasteners 136, or by other coupling means. The rotor assembly 130 is supported by a first bearing 180 and a second bearing 190. The first bearing 180 is located within the motor section 200 adjacent the first end 111 and is configured to support the end of the drive shaft 230 adjacent the first end 111. The second bearing 190 is located within the rotary machine section 300 adjacent the second end 112 and is configured to support the end of the machine rotor 330 adjacent the second end 112. The first bearing 180 and the second bearing 190 are radial bearings. The integrated machine 100 may also include a third radial bearing located between the first bearing 180 and the second bearing 190. The integrated machine 100 may further include a thrust bearing. In the embodiment illustrated, the bearings, including the first bearing 180 and the second bearing 190, are magnetic bearings. Other bearings, such as radial contact bearings, may also be used.

The radial magnetic bearings, such as, for example, the first bearing 180 and the second bearing 190 can be configured to magnetically levitate the compressor shaft, e.g., the drive shaft 230. The compressor bearing system is configured to operate with very low friction and little to no mechanical wear. Additionally, the compressor bearing system can also include auxiliary or backup bearings. A control system 370 can be coupled to the integrated machine 100 and to, for example, at least the first bearing 180 and the second bearing 190. The control system 370 can be configured for magnetic bearing control of the first bearing 180 and the second bearing 190. The control system 370 can have one or more processors or controllers operable to determine an amount of stiffness and damping required for the first bearing 180 and the second bearing 190. The control system 370 can also include a motor VFD (variable frequency drive) and a magnetic bearing controller. The VFD can control the rotational speed of the motor assembly 205. The control system 370 can use feedback from one or more sensors within the integrated machine 100. The control system 370 can be further configured to process the feedback, and then issue control commands to the VFD and one or more of the first bearing 180 and the second bearing 190.

The control system 370 can have a controller 372, a communication link 374, and a bearing input/output ("I/O") terminal 376. In particular, the controller 372 can be a computer, one or more processors, or microprocessors, coupled to one or more memories. The controller 372 can control operation and/or stiffness and damping of the magnetic bearings (e.g., the first bearing 180 and the second bearing 190). The controller 372 can be operably coupled to the bearing I/O terminal 376 via the communication link 374. The bearing I/O terminal 376 is then communicably coupled to each magnetic bearing, or magnetic bearing system (e.g., the first bearing 180 and the second bearing 190) to be controlled. In addition, the control system 370 can be dedicated to control of the magnetic bearing systems (e.g., the first bearing 180 and the second bearing 190), the motor assembly 205, or may also control other components and systems via, for example the VFD, as described herein.

The controller 372 can be any computer having real time control capability. In particular, the controller 372 can include a multi-core processor, a memory, a communication device, a power supply, a user output (e.g., a display), and a user input (e.g., a keyboard). In some embodiments, the controller 372 can be an industrial PC. For example, the controller 372 can be dedicated for control of the first bearing 180 and the second bearing 190 ("the magnetic bearing system"), or shared with one or more additional control functions.

The control system 370 can also have a bending mode measurement system 380. The bending mode measurement system 380 can be operably coupled to the control system 370 and/or the controller 372, and have one or more sensors 382. The sensors 382 can sense, among other things, deflection of the rotor assembly 130 at various frequencies including bending mode frequencies and rotational speed of the rotor assembly 130. During certain operational conditions, large bending mode deflections can occur at frequencies higher than the normal or designed operational speed of the compressor (e.g., the rotary machine 305 and rotor assembly 130) and cause damage. These bending modes can be excited by control hardware (e.g., the control system 370) due to the negative damping within, for example, the first bearing 180 and the second bearing 190, produced by control hardware delay. Thus the controller 372 can perform certain corrections (e.g., increase or decrease bearing stiffness) to produce positive damping for all bending modes within the control bandwidth of the control system 370. As used herein, control bandwidth may be referred to herein a band of bending mode frequencies (e.g., within a 0 to −3 db cutoff) within which the control system 370 has authority to make control inputs. The control bandwidth can be determined based on the bandwidth of the bearings and the power amplifiers and sensing devices (e.g., the sensors 382) within the control system 370. In some embodiments, control bandwidth can be approximately 2.5 khz. In the absence of proper damping and control, the integrated machine 100 may be damaged by unacceptable vibrations caused by unstable bending modes.

The bending mode measurement system 380 can have one or more processors and one or more associated memories configured process the bending mode information and provide such information to the controller 372. The bending mode information can be used to minimize damage to, for example, magnetic bearings (e.g., the first bearing 180 and the second bearing 190), the rotor assembly 130, and various stationary components by controlling and anticipating various bending mode manifest in the rotor assembly 130 under various operating conditions. In some embodiments, the sensors 382 of the bending mode measurement system 380 can be the bearings themselves (e.g., the first bearing 180 and the second bearing 190). In some other embodiments, the sensors 382 can be a part of first bearing 180 and the second bearing 190. Accordingly, the control system 370 or the controller 372 can scan the frequencies of various modes using the first bearing 180 and the second bearing 190 as the sensors 382. Thus, in some examples, no separate or independent measurement or sensing systems may be needed.

Figure 5:
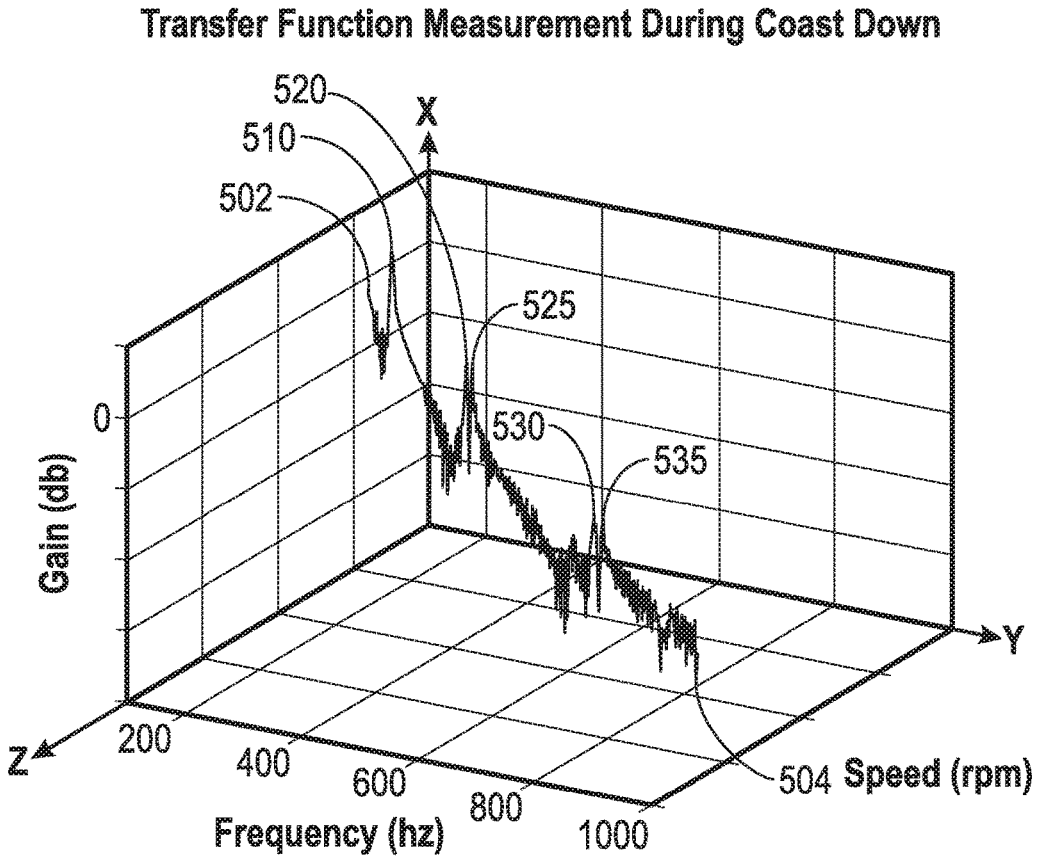
FIG. 5 is a plot diagram of transfer function measurement of the compressor of claim 2.

In measuring or "scanning" the bending mode frequencies, the bending mode measurement system 380 supply an excitation input to one or more of the first bearing 180 and the second bearing 190. The excitation input can refer to a sinusoidal current of a known frequency and magnitude sent to the bearings. The excitation input or sinusoidal current can create a physical sinusoidal force within the first bearing 180 and the second bearing 190 to shake the rotor assembly 130, at which point the rotor assembly is considered "excited." with known frequency and magnitude. The controller 372 can receive input or feedback from the sensors 382 regarding rotational speed and deflection of the rotor assembly 130 (and/or the drive shaft 230) under a given excitation frequency/magnitude. The bending mode measurement system 380 can calculate a ratio between the magnitude of rotor deflection and that of excitation. This ratio calculation can be referred to herein as "gain." The bending mode measurement system 380 can present the gain over a large frequency range (e.g., a gain plot) on which the peaks correspond to bending modes. This is described in further detail below (FIG. 5).

In some examples, the bending mode frequencies may have relatively weak gain and therefore may be difficult to sense or measure. Accordingly, the excitation inputs provided to the bearings over a range of frequencies can artificially increase the gain of the bending modes to provide a measurable response.

In some embodiments, the control system 370, in addition to one or more of its subcomponents the controller 372, the communication link 374, the bearing input/output ("I/O") terminal 376, and the bending mode measurement system 380 can be implemented in hardware, firmware, or software. One or more of each of the foregoing components can include instructions stored within a computer-readable medium to execute the functions described herein.

During normal operation, process gas 15 enters the integrated machine 100 at the suction port 310 and is routed to the inlet of the rotary machine 305. The process gas 15 is compressed by one or more centrifugal impellers 222 mounted to the machine rotor 330 and/or the drive shaft 230, diffused by one or more diffusers 250, and collected by the collector 210. The compressed process gas 15 exits the integrated machine 100 at a discharge port 320 (FIG. 1).

According to one embodiment, the process gas 15 may be controlled at or proximate the integrated machine 100. In particular, one or more flow control devices may be integrated into the integrated machine 100 as part of a compressor monitoring system. In addition, one or more flow control devices may be part of a process control system separate from the integrated machine 100.

Figure 3:
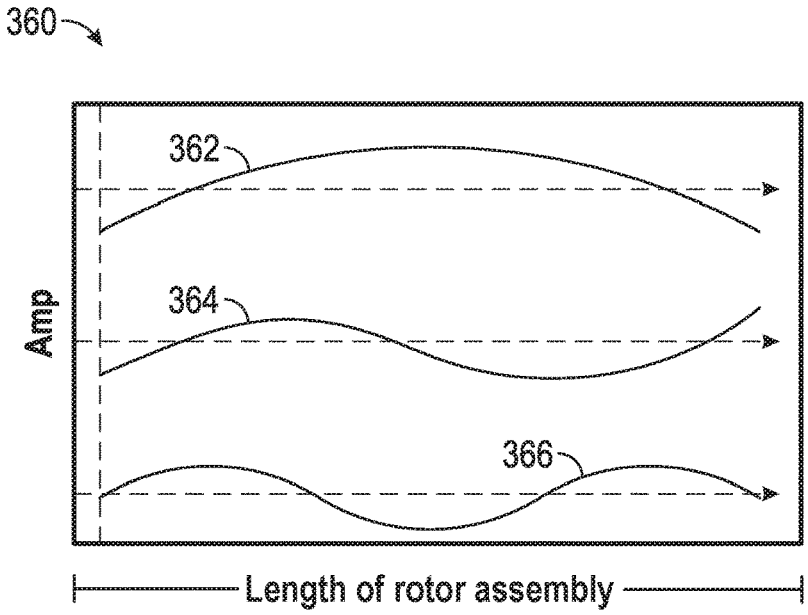
FIG. 3 is a plot diagram of modes of a drive shaft of the compressor of FIG. 2.

FIG. 3 is a plot diagram of three bending modes that are characteristic of an embodiment of the integrated machine of FIG. 2. A plot diagram 360 depicts bending modes of the rotor assembly 130, depending on bearing stiffness and rotational speed, or rpm. The bending shape of the rotor assembly 130 at such a resonance frequency is referred to as a mode. The rotor assembly 130 of the integrated machine 100 can be quite long (e.g., approximately 48 inches) and flexible, being driven by the motor assembly 205 and supported by magnetic bearings (e.g., the first bearing 180 and the second bearing 190). The length of the rotor assembly 130 can affect how many modes are present within control bandwidth. In some embodiments, the controller 372 can transmit a phase-leading response (e.g., a command to the first bearing 180 or the second bearing 190) for the rotor deflection at a given bending mode.

The plot 360 shows length of the rotor assembly 130 on the horizontal (x) axis and amplitude on the vertical (y) axis. Each mode can be present at a given frequency. For example, a first mode 362 can manifest at 762 Hz, a second mode 364 can manifest itself at 2055 Hz, and a third mode 366 can be present at 4015 Hz. The first mode 362, the second mode 364, and the third mode 366 as shown are representative and may not be drawn to scale, but are representative of the manner in which the rotor assembly 130 (and its associated components) can vibrate or oscillate when rotating.

Figure 4:
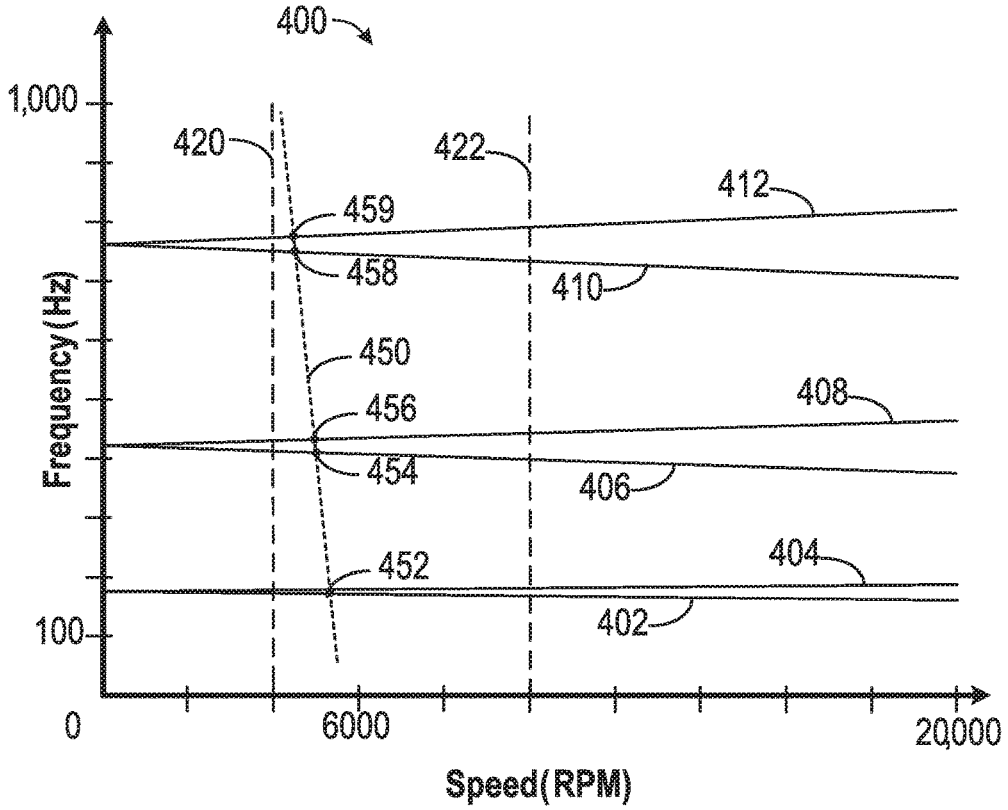
FIG. 4 is a plot diagram of gyroscopic effects on bending modes.

FIG. 4 is a plot diagram of gyroscopic effects on bending modes. A plot 400 depicts rotational speed of the rotor assembly 130 on the horizontal (x) axis and frequency of the bending modes on the vertical (y) axis. The plot 400 is an example of information used for control of the integrated machine 100.

As the rotor assembly 130 rotates, one or more portions of the rotor assembly 130 encounter a gyroscopic effect, based on the rotational speed of the rotor assembly 130, the composition and weight distribution of the rotor assembly 130. The gyroscopic effect on the rotor assembly 130 due to rotation can cause a separation of the bending modes, with one bending motion following the direction of rotation and the other being opposite to the direction of rotation. The one that follows the direction of rotation of the rotor assembly 130 is called forward bending mode, the one that is opposite to the rotation direction, is called backward bending mode. For example, a first backward bending more 402 can be associated with a first forward bending mode 404, a second backward bending mode 406 can be associate with a second forward bending mode 408, and a third backward bending mode 410 can be associated with a third forward bending mode 412. Additional modes can be present based on the bending mode frequencies and shaft speeds measured.

As shown in the plot 400, the frequencies of the backward bending modes 402, 406, 410 decrease with speed, while the frequencies of the forward bending modes 404, 408, 412 increase with speed. Accordingly, as rotational speed of the rotor assembly 130 increases (e.g., to the right), the frequency backward bending modes 402, 406, 410 and the forward bending modes 404, 408, 412 are increasingly divergent. Thus, while at 0 rpm, the forward and backward bending mode can be indistinguishable from one another. Bending modes can be present due to, for example, variations mass or material strength along the of the rotor assembly 130. The range of the frequency scale can be, for example, zero Hz to 1000 Hz, while the rotational speed scale can be, for example, zero rpm at the origin to 20,000 rpm on the right. Thus, it can be see that at higher rotational speeds (e.g., 20,000 rpm), the forward and backward bending mode frequencies can be separated by large increments, for example, 100 Hz or more. Intermediate rotational speeds can produce intermediate differences in mode frequency.

Given the length of the rotor assembly 130, many of the bending mode frequencies fall within the control bandwidth of the magnetic bearing control system 380. As used herein, the control bandwidth can refer to a range of frequencies within which the control system 370 has adequate authority to control the first bearing 180 and the second bearing 190. In some examples, not all of the bending modes of the rotor assembly 130 will be stable, which at certain rotational speeds, can damage the rotor assembly 130 or other components of the integrated machine 100. Accordingly, knowing the frequencies of these modes at different speeds can be important for stable operation of an integrated machine 100 using magnetic bearings. Thus measuring the bending mode frequencies is essential for such a machine, as it provides an effective way to verify the analytical prediction, but also the necessary information to tune the control system and check stability margin of such a system.

In some examples, bending mode frequencies can be measured at multiple constant speeds. Such measurements can be made using the control system 370 and a magnetic bearing (e.g., the first bearing 180 and the second bearing 190) to apply an excitation force over one or more frequencies to the rotor assembly 130 and measure the response at the same time. In some embodiments, the controller 372 can transmit one or more command signals (S1) to one or more amplifiers that can adjust current (e.g., a controls signal) to each of the first bearing 180 and the second bearing 190. The current applied to the bearings can adjust a bearing force for each bearing to keep the rotor assembly 130 levitated. During, for example, single speed bending mode measurements, the VFD within the control system 370 can hold the integrated machine 100 at a constant speed. A sinusoidal excitation signal (S2) having a given frequency f and number of cycles, can be added to the command signal (S1) to create a total signal (S3). The total signal (S3) can be sent to the one or more amplifiers. The controller 372 can receive information or measurements regarding deflection of the rotor assembly 130 from the sensors 382 based on the total signal (S3). The controller 372 can further extract an indication of the magnitude of the deflection of the rotor assembly 130 at one or more frequencies, and the magnitude of the total signal (S3) at the frequency f, and can calculate the ratio between the two. This ratio of magnitude of the vibrations in the rotor assembly to the magnitude of the excitation input (e.g., force) can be referred to herein as "gain." The bending mode measurement system 380 can present the gain over a large frequency range, e.g., a gain plot, on which the peaks of increased gain correspond to various bending modes or bending mode frequencies. This is described in connection with FIG. 5, below. The excitation force can be sinusoidal and the frequency of excitation can sweep through a range that covers the bending modes of interest. The excitation input or force applied to the rotor assembly 130 can be a physical displacement force, for example, physically shaking the rotor assembly 130. In some examples, the excitation force is sinusoidal to isolate the force to a signal frequency. While signals (e.g., the signal S2) of other forms can be implemented, multiple frequencies can complicate the measurement process. Such a measurement is often referred as a transfer function measurement and can be accomplished when the drive shaft 230 and rotor assembly 130 is maintained at a constant rotational speed.

Because bending modes vary across frequency and rotational speed, the plot 300 and the plot 400 can be derived via multiple transfer function measurements in order to measure bending mode frequencies at various speeds. For example, the rotor assembly 130 can be maintained at a constant speed while measurements are taken over the range of frequencies. For example, a first measurement can be taken at zero rpm, as bending modes exists at zero rpm given the finite stiffness of the materials composing the rotor assembly 130. The rotary machine 305 can be accelerated to a second rpm and the frequencies can be swept along the line 420, for example. This can be done successively throughout a range of desired rotational speeds until the plot 400 can be derived either empirically or via interpolation or extrapolation from the measured results. For example, bending mode frequencies derived at for example, 0 rpm, along the line 420 at 4,000 rpm, and then again at a line 422 at 8,000 rpm may provide data sufficient to derive the plot 400.

However, when measuring the bending mode frequencies with motor section 200 powering the rotary machine 305 at a given speed, certain interference is present and can negatively affect the measurements. For example, such interference can be electrical or electromagnetic interference. The measurements can experience strong electrical interference from, for example, the motor assembly 205, the controller 372 and VFD (or the control system 370). Thus the measurements can be contaminated with a significant electrical noise with the motor section powered on. This can overwhelm the responses at bending mode frequencies, making the bending mode frequencies difficult or impossible to read.

FIG. 5 is a three dimensional plot diagram of transfer functions using a coast down measurement method. A 3D plot 500 depicts a transfer function measurement during coast down of the integrated machine 100. The 3D plot 500 shows gain in decibels (dB) on the x-axis versus frequency in Hz on the y-axis and rotational speed (rpm) on the z-axis. The origin of the gain scale is indicated with a value of zero. However, speed and frequency have values associated with the desired frequency and initial speed of the rotary machine 305. Accordingly, the values of speed decreases and frequency increases (over time) moving right and out of the page with respect to the 3D plot 500.

As disclosed herein the bending mode measurements can be taken after power is removed from the rotary machine 305. Thus, instead of holding the rotational speed of the rotary machine 305 unchanged with the motor section 200 powered on while measurements are taken, the rotary machine 305 can be accelerated to a desired rotational speed at a point 502 and allowed to slow, or coast down, in an unpowered state. The coast down can occur in a no-load or low-/very low-load condition. The frictionless (or very low friction) magnetic bearings (e.g., the first bearing 180 and the second bearing 190) also provide a relatively long time in which to take measurements before the rotor assembly 130 and the rotary machine 305 come to rest at, for example, zero rpm. This can reduce or eliminate the electrical interference associated with the motor assembly 205 and other electronics. For example, during one such coast down period, a machine speed or rotational speed of the rotor assembly 130 decreases, the bending mode frequencies can be scanned (e.g., using the excitation forces to the bearings) from a low frequency up to a higher frequency. A scan from high frequency to low frequency is also possible.

The rotary machine 305 can be powered up to a desired initial speed at the point 502. Then the power can be removed allowing the rotor assembly 130 and the rotary machine 305 can coast down from the initial speed toward a point 504 and toward zero rpm.

During the coast down measurement, the speed of the rotor assembly 130 at each excitation frequency, the mode frequency response, and the gain of each bending mode based on the excitation forces can be calculated and/or recorded. Gain can be referred to as the ratio of magnitude of deflection of the rotor assembly 130 and magnitude of excitation force sent by the controller 372 to, for example, an amplifier or the bearings 180, 190 at a certain frequency. This can provide the three dimensional plot 500, as opposed to a two-dimensional plot showing, for example, frequency plotted against gain measured at a single, constant rotational speed. On the 3D plot 500, each bending mode is recorded at a different speed, as the rotor slows down gradually during the process of the measurement. The rotary machine 305 can be powered back up to different speeds to conduct the coast down bending mode measurement from different speeds, each time achieving a 3D plot of gain versus speed and frequency. Then the plot 400 can be created using multiple 3D plots 500 are completed.

As shown, the starting point of the transfer function of the 3D plot 500 is determined by a speed associated with the point 502. This can be a predetermined starting point for a first iteration of the coast down method. Referring briefly to FIG. 4, the measurements of the 3D plot 500 can follow a line 450 shown as a dotted line in the plot 400. As the rotary machine 305 coasts down, a first backward bending mode and a first forward bending mode can be measured at a point 510. The forward and backward bending modes at point 510 are very close together and appear at a single point. This example is similar to the proximity of the first backward bending mode 402 and the first forward bending mode 404 at a point 452 on the plot 400. A second backward bending mode can occur at a point 520 and a second forward bending mode can be measured at a point 525. The point 520 and the point 525 can correspond respectively with a point 454 and a point 456 on the line 450. In a similar manner, a third backward bending mode is shown at a point 530 and a third forward bending mode is shown at a point 535. The point 530 and the point 535 can also correspond respectively with a point 458 and a point 459 on the line 450. Thus, successive iterations of the coast down measurements can provide interference-free data for tracking and controlling bending modes in the integrate machine 100.

Figure 6:
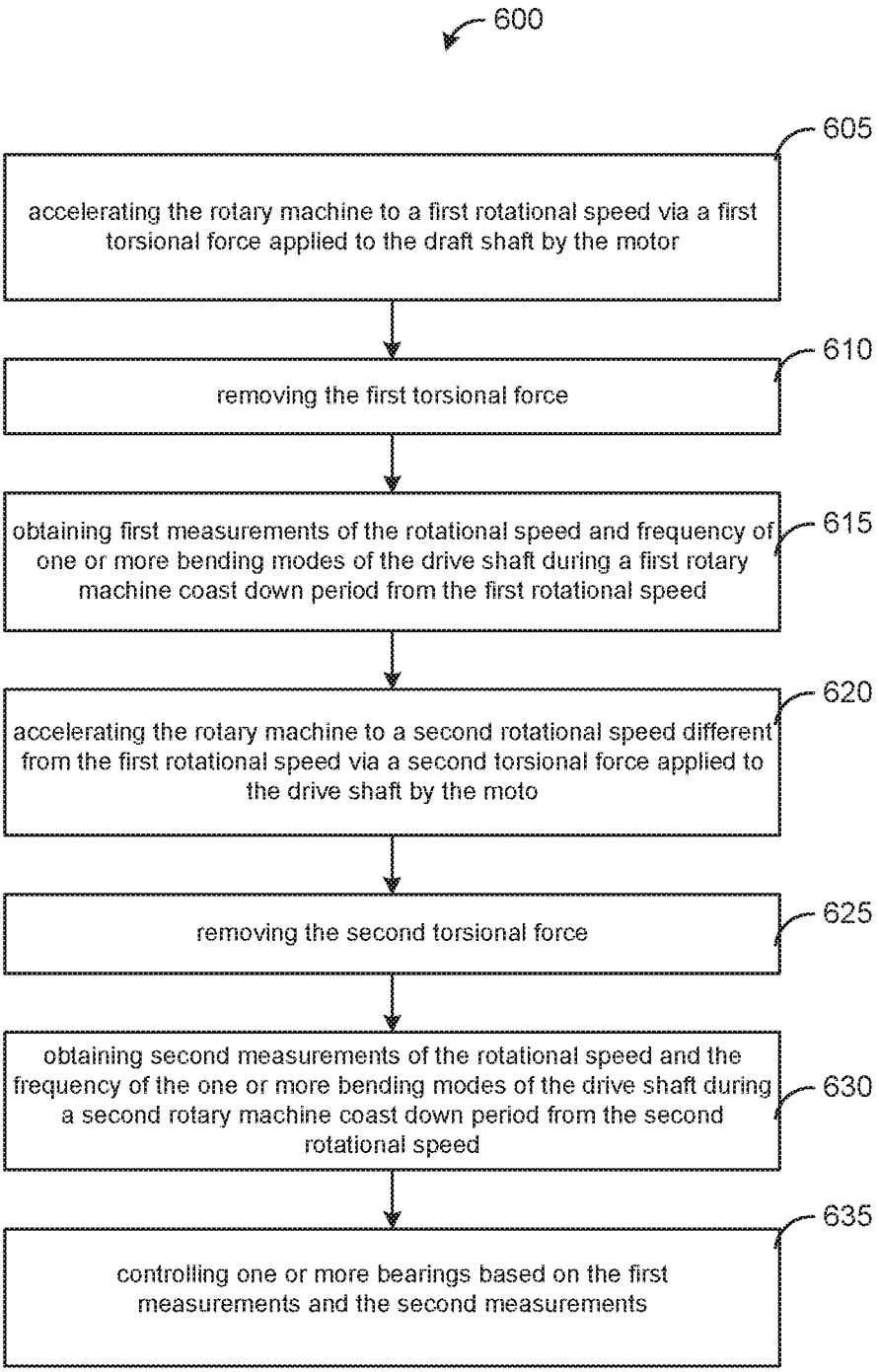
FIG. 6 is a flowchart of a method for measuring a transfer function during coast down of the compressor of FIG. 2.

FIG. 6 is a flowchart of a method for measuring bending modes in the integrated machine 100. A method 600 can be performed using the integrated machine 100. As described herein, the integrated machine 100 can have the rotor assembly 130, comprising the machine rotor 330 and the drive shaft 230. The control system 370 (e.g., the controller 372 and VFD) can perform operations that control the functions of the integrated machine 100 to sense bending mode frequencies of the rotor assembly 130 and control the first bearing 180 and the second bearing 190 in response to the bending mode frequencies. The bending mode measurement system 380 can then sense bending mode frequencies and gain. The controller 372 can then adjust the operations of the integrated machine 100 or the bearings based on the bending mode frequencies and associated rotational speed of the drive shaft 230 and/or rotor assembly 130.

At block 605, the controller 372 can accelerate the rotary machine 305 to a first rotational speed via a first torsional force applied by the motor assembly 205 to the draft shaft 230. As noted in connection with FIG. 5, the first torsional force can be removed at block 610. The removal of the first torsional force can allow the rotor assembly 130 to coast down during a first coast down period from the first rotational speed toward zero rpm. This can allow the bending mode measurement system 380 to record measurements of various bending mode frequencies at block 615 (e.g., FIG. 1) while minimizing interference from other electronic or mechanical components for the integrated machine 100. During the bending mode measurements, excitation forces of one or more frequencies can be applied to the first bearing 180 and the second bearing 190. The bending mode measurement system 380 can sweep through a range of frequencies during each measurement cycle. The excitation forces can physically shake the rotor assembly 130 and provide a measurable response (e.g., fore the sensors 382) at the various bending mode frequencies.

At block 620, the controller 372 can accelerate the rotary machine 305 to a second rotational speed via a second torsional force applied by the motor assembly 205 to the draft shaft 230. The second rotational speed can be different (e.g., greater or less) than the first rotational speed. At block 625, the second torsional force can be removed, again allowing the rotor assembly 130 to coast down during a second coast down period from the second rotational speed toward zero rpm.

At block 630, the bending mode measurement system 380 can determine or otherwise obtain second measurements of the rotational speed and the frequency of the one or more bending modes of the rotor assembly 130 during a second rotary machine coast down period from the second rotational speed. Again, this can allow measurement of the bending mode frequencies without interference from the electrical components of the integrated machine 100. During the second measurements, the bending mode measurement system 380 can sweep through a range of frequencies for the excitation force to measure the gain of the various bending modes.

The controller 372 can determine a relationship between rotational speed of, for example the rotor assembly 130, (e.g., the machine rotor 330, and the drive shaft 230) and the one or more bending modes, based on the first measurements and the second measurements. The bending mode frequencies can be swept (e.g., measured) during the first and second coast down periods to determine the various speed, gain, and frequency relationships. The first and second coast down periods can generate a three dimensional graph of the transfer function, as shown in FIG. 5. As multiple coast down periods are performed, various other data can be determined to characterize the bending mode frequencies across a range of rotational speeds as shown in the FIG. 4. The method 600 can be repeated until all of the data from the plot 400 is known or sufficient data are measured to interpolate or extrapolate the remaining values.

At block 635, the controller 372 can also control the one or more bearings (e.g., the first bearing 180 and the second bearing 190) based on the relationship between the rotational speeds of the drive shaft 230 and the bending mode frequencies. In some other embodiments, the bending mode measurement system 380 can continue to sweep various bending mode frequencies during operations to ensure proper control of first bearing 180 and the second bearing 190 during actual compressor operations. This can also provide some feedback to the controller 372 for proper damping of the bearing system.

INDUSTRIAL APPLICABILITY

The present disclosure generally applies to a bending mode measurement system 380 in an industrial gas compressor. The described embodiments are not limited, however, to use in conjunction with a particular type of gas compressor (e.g., centrifugal, axial, etc.). Gas compressors such as centrifugal gas compressors are used to move process gas from one location to another. Centrifugal gas compressors are often used in the oil and gas industries to move natural gas in a processing plant or in a pipeline. Centrifugal gas compressors can be driven by gas turbine engines, electric motors, or any other power source.

In some instances, embodiments of the presently disclosed control system are applicable to the use, operation, maintenance, repair, and improvement of centrifugal gas compressors, and may be used in order to improve performance and efficiency, decrease maintenance and repair, and/or lower costs. In addition, embodiments of the presently disclosed bending mode measurement system 380 may be applicable at any stage of the centrifugal gas compressor's life, from design to prototyping and first manufacture, and onward to end of life. Accordingly, the bending mode measurement system 380 may be used in conjunction with a retrofit or enhancement to existing centrifugal gas compressors, as a preventative measure, or even in response to an event.

There is a desire to achieve greater efficiencies, reduce emissions, and reduce mechanical wear and maintenance requirements in large industrial machines such as centrifugal gas compressors. Optimum use of magnetic bearings in a centrifugal gas compressor may accomplish these goals. Centrifugal gas compressors can achieve greater efficiencies with magnetic bearings by eliminating any contact between the bearings and rotary element. However improper bearing control and uncontrolled or unknown bending modes and bending mode frequencies can damage compressor (or motor) components and shorten operational life. Magnetic bearings may use electromagnetic forces to levitate and support the rotary element without physically contacting the rotary, element eliminating the frictional losses. However, as the rotor assembly 130 flexes or bends according to the bending modes, damage to the bearings can occur if not anticipated.

The bending mode measurement system 380 can provide useful metrics by which to measure bending modes, enabling the system to anticipate and adapt magnetic bearing control in response. Magnetic bearings, such as the first bearing 180 and the second bearing 190, can provide proper stiffness and damping to limit vibration of the rotor assembly 130 at synchronous speed. Magnetic bearings have to provide positive damping to all bending modes beyond any maximum rotational speeds and up to the control bandwidth of the control system 370. The control system 370 can provide high speed communications between feedback sensors 382 and according to measurements taken by the bending mode measurement system 380. The bending mode measurement system 380 can use several iterations of the coast down method (FIG. 6) to allow more accurate measurement of bending mode frequencies in the integrate machine 100.

The preceding detailed description is merely exemplary in nature and is not intended to limit the invention or the application and uses of the invention. The described embodiments are not limited to use in conjunction with a particular type of machine. Hence, although the present embodiments are, for convenience of explanation, depicted and described as being implemented in an integrated machine, it will be appreciated that the bending mode measurement system including the controller, various processors, the sensors, and the gain calculations can be implemented in various other types of electric motors, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A method for controlling bending modes of a rotor assembly supported by one or more bearings in an integrated machine having a rotary machine operably coupled to an electric motor via a drive shaft and controlled by a control system, the method comprising:

accelerating the rotary machine to a first rotational speed via a first torsional force applied to the drive shaft by the electric motor;

removing electric power from the electric motor;

obtaining first measurements of the rotational speed and frequency of one or more bending modes of the rotor assembly during a first coast down period from the first rotational speed while the electric power is removed from the electric motor;

accelerating the rotary machine to a second rotational speed different from the first rotational speed via a second torsional force applied to the drive shaft by the electric motor;

removing electric power from the electric motor;

obtaining second measurements of the rotational speed and the frequency of the one or more bending modes of the rotor assembly during a second coast down period from the second rotational speed while the electric power is removed from the electric motor;

obtaining first and second measurements of gain of the one or more bending modes versus corresponding first and second measurements of frequency and rotational speed; and controlling the one or more bearings based on the first measurements and the second measurements.

2. The method of claim 1, further comprising determining a relationship between the rotational speed, the frequency, and the gain of the one or more bending modes.

3. The method of claim 1, wherein obtaining the first and second measurements of gain further comprise applying an excitation force to the one or more bearings during the first and second coast down periods and the gain is a ratio of a magnitude of the one or more bending modes to a magnitude of the applied excitation force applied to the one or more bearings during the first and second coast down periods.

4. The method of claim 1 further comprising applying an excitation force to the one or more bearings during the first coast down period.

5. The method of claim 1, further comprising performing corrections to produce positive damping for all bending modes within a control bandwidth of the control system.

6. The method claim 1 wherein the one or more bearings are magnetic bearings.

7. The method claim 1 wherein first torsional force and the second torsional force are different.

8. A device for controlling one or more magnetic bearings of an integrated machine, the device comprising:

rotary machine;

an electric motor;

a drive shaft coupling the rotary machine to the electric motor to define a rotor assembly supported by one or more magnetic bearings;

a control system coupled to the electric motor and the one or more magnetic bearings operable to accelerate the rotary machine to a first rotational speed via a first torsional force applied to the draft shaft by the electric motor;

removing electric power from the electric motor;

obtain first measurements of the rotational speed and frequency of one or more bending modes of the rotor assembly during a first coast down period from the first rotational speed;

accelerate the rotary machine to a second rotational speed different from the first rotational speed via a second torsional force applied to the drive shaft by the electric motor;

remove electric power from the electric motor;

obtain second measurements of the rotational speed and the frequency of the one or more bending modes of the rotor assembly during a second coast down period from the second rotational speed while the electric power is removed from the electric motor;

determine a relationship between at least one forward bending mode and a least one backward bending mode over a range of frequencies based on the first measurements and the second measurements; and control the one or more bearings based on the first measurements and the second measurements.

9. The device of claim 8 wherein the rotary machine comprises a gas compressor.

10. The device of claim 8, wherein the control system is further configured to obtain first and second measurements of gain of the one or more bending modes versus corresponding first and second measurements of frequency and rotational speed.

11. The device of claim 10, wherein obtaining the first and second measurements of gain comprise applying an excitation force to the one or more bearings during the first and second coast down periods gain is a ratio of a magnitude of the one or more bending modes to a magnitude of an excitation force applied to the one or more bearings during the first and second coast down periods.

12. The device of claim 8 wherein the control system is further configured to perform corrections to produce positive damping for all bending modes within a control bandwidth of the control system.

13. A method for controlling bending modes of a rotor assembly supported by one or more bearings in an integrated machine having a rotary machine operably coupled to an electric motor via a drive shaft and controlled by a control system, the method comprising:

accelerating the rotary machine to a first rotational speed via a first torsional force applied to the drive shaft by the electric motor;

removing electric power from the electric motor;

obtaining first measurements of the rotational speed and frequency of one or more bending modes of the rotor assembly during a first coast down period from the first rotational speed while the electric power is removed from the electric motor;

applying an excitation force to the one or more bearings during the first coast down period;

accelerating the rotary machine to a second rotational speed different from the first rotational speed via a second torsional force applied to the drive shaft by the electric motor;

removing electric power from the electric motor;

obtaining second measurements of the rotational speed and the frequency of the one or more bending modes of the rotor assembly during a second coast down period from the second rotational speed while the electric power is removed from the electric motor; and controlling the one or more bearings based on the first measurements and the second measurements.

* * * * *